US006386085B1

(12) United States Patent
Garrett

(10) Patent No.: US 6,386,085 B1
(45) Date of Patent: May 14, 2002

(54) METHOD AND APPARATUS FOR EXPLOSIVES ASSEMBLY

(76) Inventor: Betty A. Garrett, 233 Ellington Rd., Apt. 211, East Hartford, CT (US) 06108

( * ) Notice: Subject to any disclaimer, the term of this patent is extended or adjusted under 35 U.S.C. 154(b) by 0 days.

(21) Appl. No.: 09/470,901

(22) Filed: Dec. 23, 1999

Related U.S. Application Data

(60) Provisional application No. 60/113,708, filed on Dec. 24, 1998.

(51) Int. Cl.[7] ..... C06B 21/00

(52) U.S. Cl. ..... 86/1.1; 86/10; 86/23; 86/24; 86/22; 102/202.12; 102/275.1; 102/275.2; 102/275.6; 102/275.12

(58) Field of Search ..... 102/202, 12, 275.1, 102/275.2, 275.6, 275.7, 275.12, 293; 86/1.1, 10, 20.1, 21, 22, 23, 24

(56) References Cited

U.S. PATENT DOCUMENTS 1,732,676 A * 10/1929 Erbele ..... 86/21
5,377,592 A * 1/1995 Rode et al. ..... 102/210
5,499,581 A * 3/1996 Sutula, Jr. ..... 102/275.12
5,792,975 A * 8/1998 Tseka et al. ..... 102/275.7

* cited by examiner

*Primary Examiner*—Harold J. Tudor
(74) *Attorney, Agent, or Firm*—Alix, Yale & Ristas, LLP

(57) ABSTRACT

A method for assembling a blast initiation device is provided. The method comprises providing a length of signal transmission line having first and second ends, mounting a tag to the line and mounting a first detonator to the first end of the line wherein all of the steps are each performed at a single operator station by a single operator. Also provided is an apparatus for utilizing the method. The apparatus comprises a tagger device for mounting a tag to a length of signal transmission line having first and second ends. A crimp device is adjacent the tagger device for mounting a first detonator to the first end of the line. A blocker device is adjacent the detonator crimp device for locking a connecting block to the first detonator. The tagger, crimp and blocker devices are spatially arranged adjacent an access position for ease of operation by a single operator. Further provided is a kaizen cell comprising a plurality of workstations.

20 Claims, 8 Drawing Sheets

METHOD AND APPARATUS FOR EXPLOSIVES ASSEMBLY

CROSS REFERENCE TO RELATED APPLICATIONS

This application claims the benefit of United States Provisional Application No. 60/113,708, filed Dec. 24, 1998.

BACKGROUND OF THE INVENTION

This invention relates generally to assembly of explosive devices. More particularly, the present invention relates to an apparatus and method for the assembly of blast initiation devices.

It is common practice in blasting operations to initiate the detonation of one or more main explosive charges by transmitting an initiation signal to the charges through initiation signal transmission lines. There are various conventional forms of signal transmission lines, e.g., detonating cord, shock tube, low velocity signal tube, etc. It is often necessary to transfer an initiation signal from a first transmission line to a second transmission line or a plurality of second transmission lines, such as when long distances are involved or when multiple main charges must be initiated. It may also be necessary to amplify the initiation signal from the first line to accomplish the initiation signal transfer to a second line or a plurality of second lines. This may be accomplished by using the initiation signal to initiate a detonator mounted to the first line and disposed in signal transfer relation to the second transmission line or lines. Typically, this is accomplished with a connector device. The connector device includes a body portion having a channel holding the detonator cap and an engaging member for holding one or more signal receiving transmission lines in signal transfer relationship to the detonator cap. The end of the signal transmission line opposing the connector block may be connected to an initiator for initiating a signal in the transmission line or, alternatively, may be connected to another detonator.

SUMMARY OF THE INVENTION

An object of the invention is to provide an improved method and apparatus for the assembly of blast initiation devices.

Another object of the invention is to provide an improved method and apparatus for the assembly of blast initiation devices which may be efficiently utilized by a single operator.

Other objects and advantages of the invention will become apparent from the drawings and the specification.

Briefly stated, the invention in a preferred form is a new and improved method for assembly of a blast initiation device. The invention also encompasses an apparatus for use with the method. The apparatus in preferred form is an inventive single operator workstation.

The workstation comprises a tagger device for fixing an identification tag to a predetermined length of a transmission line. A crimp device is located on the workstation. The workstation operator loads a detonator within an aperture in the crimp device, inserts a bushing within the detonator and places the end of the transmission line within the bushing. Actuation of the crimp device crimps the outside of the detonator at a predetermined location and to a predetermined depth to securely fasten the transmission line and bushing to the detonator. In a preferred embodiment, the crimp device comprises a dual crimp head with two apertures. The workstation operator loads a desired detonator in each aperture of the dual crimp head. A bushing is inserted within each detonator and both ends of the transmission line are inserted within a respective bushing and held adjacent an explosive charge within the detonator. Actuation of the dual crimp head crimps each of the detonators at a predetermined location and to a predetermined depth substantially simultaneously. The detonator crimping operation creates a cannelure at least partially around the circumference of the detonator.

The operator places a connector block over one crimped detonator. The workstation includes a blocker device adjacent the cap crimp device. The connector/detonator/transmission line subassembly is placed in the blocker device. The blocker device drives a locking member into the connector block. The locking member includes spaced legs, each of which is driven into an opposing side of the detonator cannelure. The blocker device fixes the position of the detonator/transmission line within the connector block. It should be realized that the inventive workstation is arranged so that a single operator can safely and expediently operate all of the above devices and handle the high explosive components to create an assembled blast initiation device.

Preferably, the workstation is adjacent a feeder to provide a supply of predetermined lengths of coiled transmission line to the operator and includes feeders or holders to provide the operator with a ready supply of detonator, bushings and connector blocks. Naturally, the component feeders are designed and located so that explosive components, such as detonators while available for quick access by the operator are also safely contained. The workstation is preferably located adjacent a bundler. The bundler receives a predetermined number of blast initiator assemblies; bands the predetermined number of assemblies together; and transfers the banded assemblies to a pack-out station.

In use of a preferred embodiment of the inventive workstation, an operator loads a desired detonator in each of the two crimp head apertures. A bushing is placed within each of the detonators. The operator receives a predetermined length of coiled transmission line and attaches a tag with the tagger device adjacent one end of the line. The operator inserts each end of the transmission line into a respective bushing/detonator subassembly so that the end of the transmission line is adjacent the explosive charge in the detonator. Actuation of the crimp head causes a crimp to be formed in the metal housing of the detonator, securing the detonator through the bushing to the transmission line. The operator removes from the crimp head aperture one end of the transmission line with the now attached detonator and places the attached detonator within the bore of a connector block. The connector block/detonator/transmission line subassembly is placed in a blocker device. The blocker device drives a locking member through the connector block so that the locking member legs are driven into the cannelure formed during the detonator crimp operation. This operation locks the detonator to the connector block. The operator removes the locked connector block/detonator/transmission line subassembly from the blocker and the opposing crimped detonator/transmission line end from the crimp head aperture. The operator places the assembled blast initiator device in a bundler. When a predetermined number of initiator devices have been placed in a bundler, the operator actuates the bundler to band the predetermined number of devices together into a bundle and to transfer the bundled devices to a pack-out station for subsequent packaging.

BRIEF DESCRIPTION OF THE DRAWINGS

Other objects and advantages of the invention will be evident to one of ordinary skill in the art from the following detailed description may with reference to the accompanying drawings, in which.

DETAILED DESCRIPTION OF THE PREFERRED EMBODIMENTS

Figure 6:
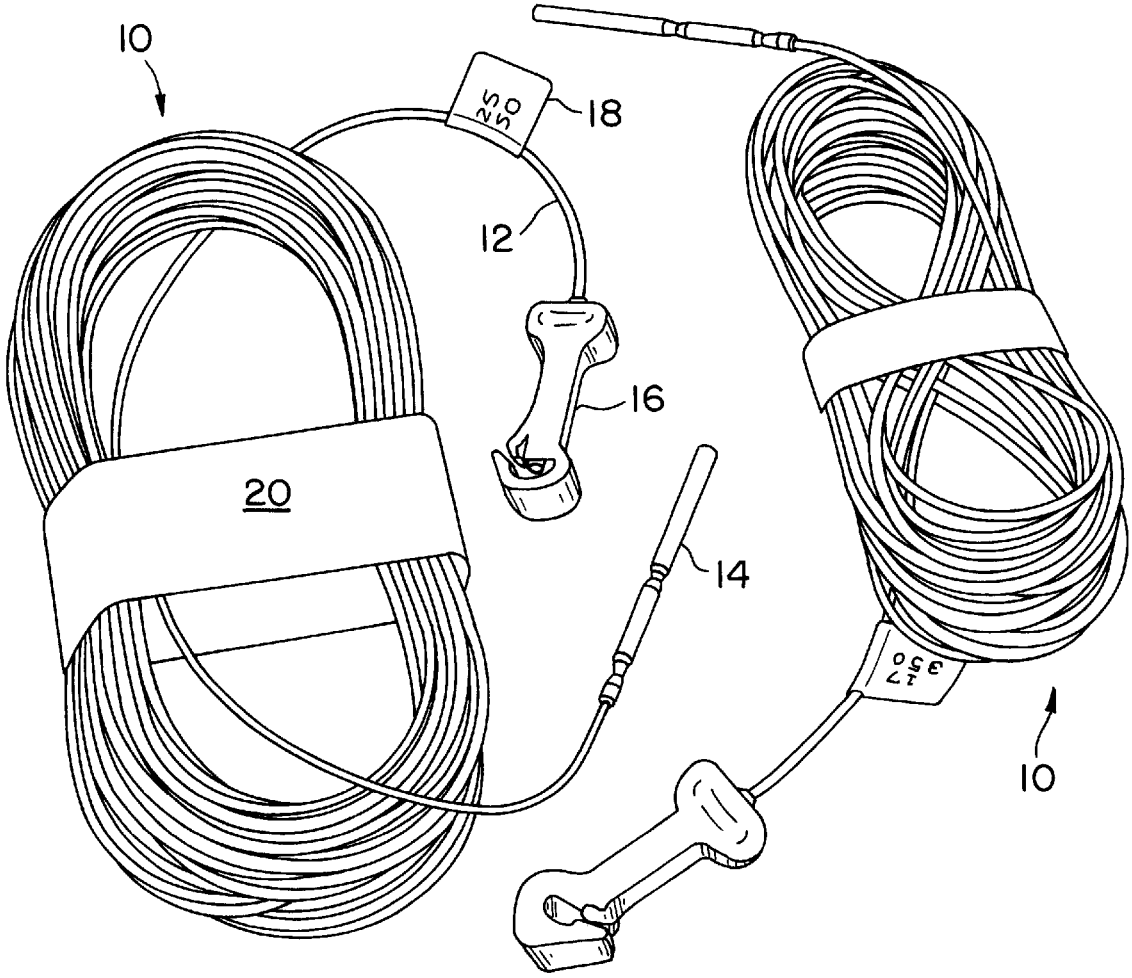
FIG. 6 PRIOR ART
FIG. 6 is a perspective view of two conventional blast initiation devices.

With reference to the drawings, wherein like numerals designate like components throughout the Figures, a blast initiation device as shown in FIG. 6 is generally designated 10. The blast initiation device comprises a length of signal transmission line or tube 12 which is attached at each end to a detonator 14. A connector block 16 is mounted to a detonator (not visible) at one end of the blast initiation device. An identification tag 18 is affixed to the signal transmission line 12 adjacent one end. The transmission line 12 of the blast initiation device is coiled and held by a tape or band 20 to allow packing, transportation, and handling.

The signal transmission line or tube 12 typically comprises hollow plastic tubing. The inside surfaces of the transmission tube are coated with reactive material, such as, a mixture of a high brisance explosive and aluminum powder in the case of shock tube or a deflagrating material in the case of low velocity signal transmission tube. The inventive method and apparatus may be used with any suitable signal transmission line, such as, for instance, shock tube, low velocity signal transmission tube or low energy detonating cord.

Figure 7:
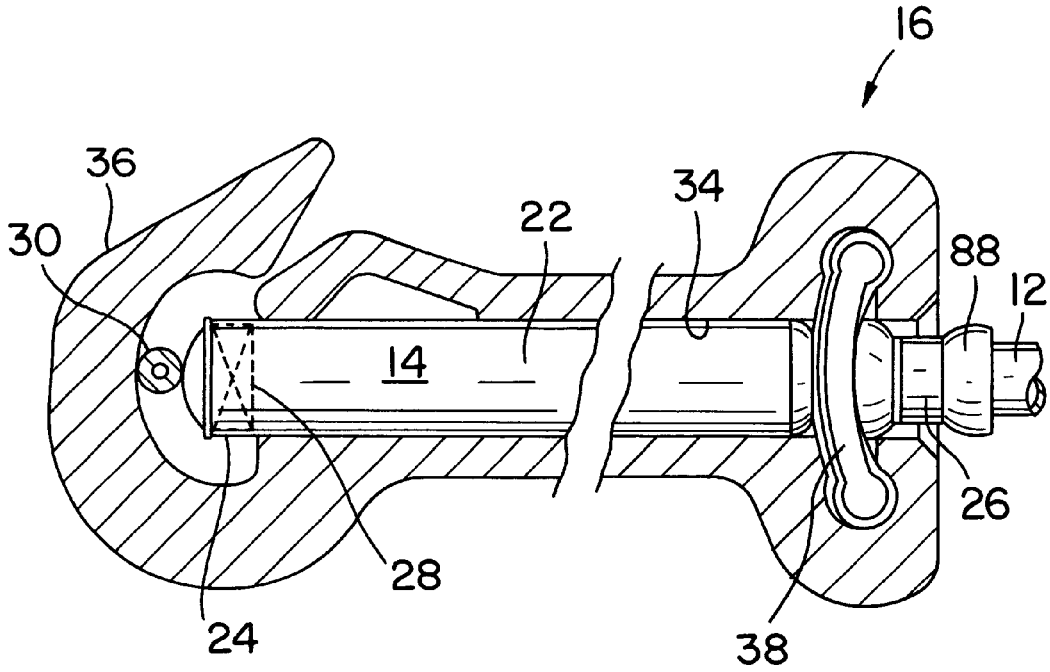
FIG. 7 PRIOR ART
FIG. 7 is a side view, partly in section, of a connector with a detonator and signal transmission line inserted therein.
Figure 8:
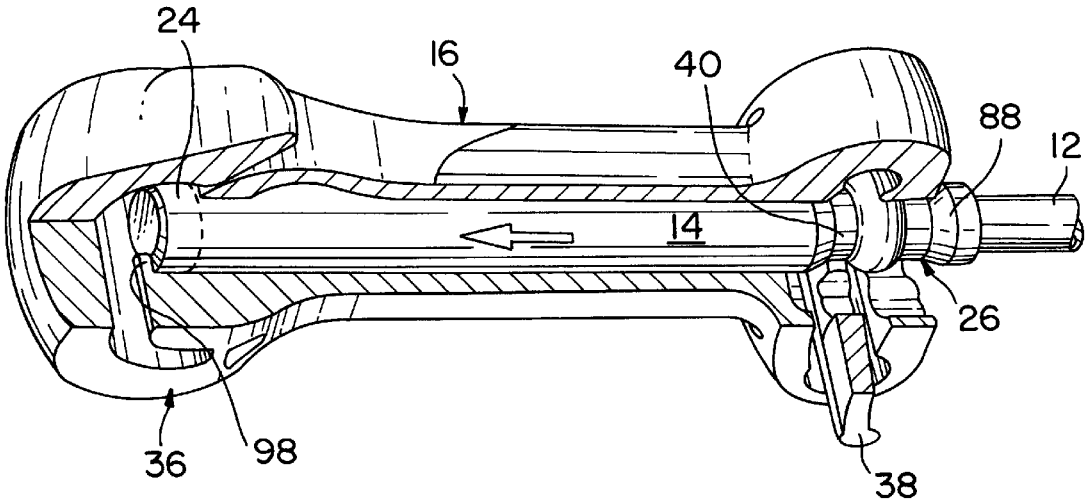
FIG. 8 PRIOR ART
FIG. 8 is a perspective, cut away and partly in section side view of a connector with a detonator and signal transmission line inserted therein.

A detonator 14 is firmly attached to at least one end of the signal transmission line 12 by a method such as crimping. The detonator may be an instant acting detonator or a delayed detonator, both types being of course well known in the art. If a detonator 14 is attached at each end of the signal transmission line 12, each detonator may be of a different delay or explosive force. Alternatively, an initiator device (not shown) may be attached to one end of the signal transmission line 12 to initiate a signal within the tube. With reference also to FIGS. 7 and 8, the detonator 14 comprises a generally tubular shaped housing 22, having an axially extending channel formed therein, with a closed end 24 and an open end 26 opposite the closed end. An explosive charge 28 is placed within the channel at the closed end 24 of the housing 22. The explosive charge 28 is typically comprised of a base charge of a secondary explosive, such as, pentaerythritol tetranitrate (PETN) adjacent the housing-closed end. An initiating charge comprising a primary explosive such as lead azide overlays the base charge.

The normal functioning of the detonator 14 requires that a signal transmission line 12 transmit an initiating signal to be applied to the initiating charge to cause it to detonate and thereby activate the base charge. The activated base charge amplifies the initiating signal to initiate further signals in receiving or receptor signal transmission lines 30 or to activate a main explosive charge. The initiating signal can take the form of a detonation shock wave from a shock tube, a deflagrating flame front from a deflagrating type tube, or a detonation from a detonating cord.

One detonator 14 is fixedly mounted in an axial channel 34 defined within a connector block 16. The detonator closed end 24 is adjacent a receiving line retaining end 36 of the connector block 16 to be in signal transmission relationship with receptor signal transmission lines engaged therein. The detonator 14 is retained within the axial channel 34 by engagement at a locking member 38 with a crimp 40 formed in the detonator housing 22. U.S. Pat. No. 5,792,975, issued Aug. 11, 1998, which is incorporated by reference herein, discloses a blast initiation device 10 suitable for assembly by the inventive method and apparatus.

Figure 1:
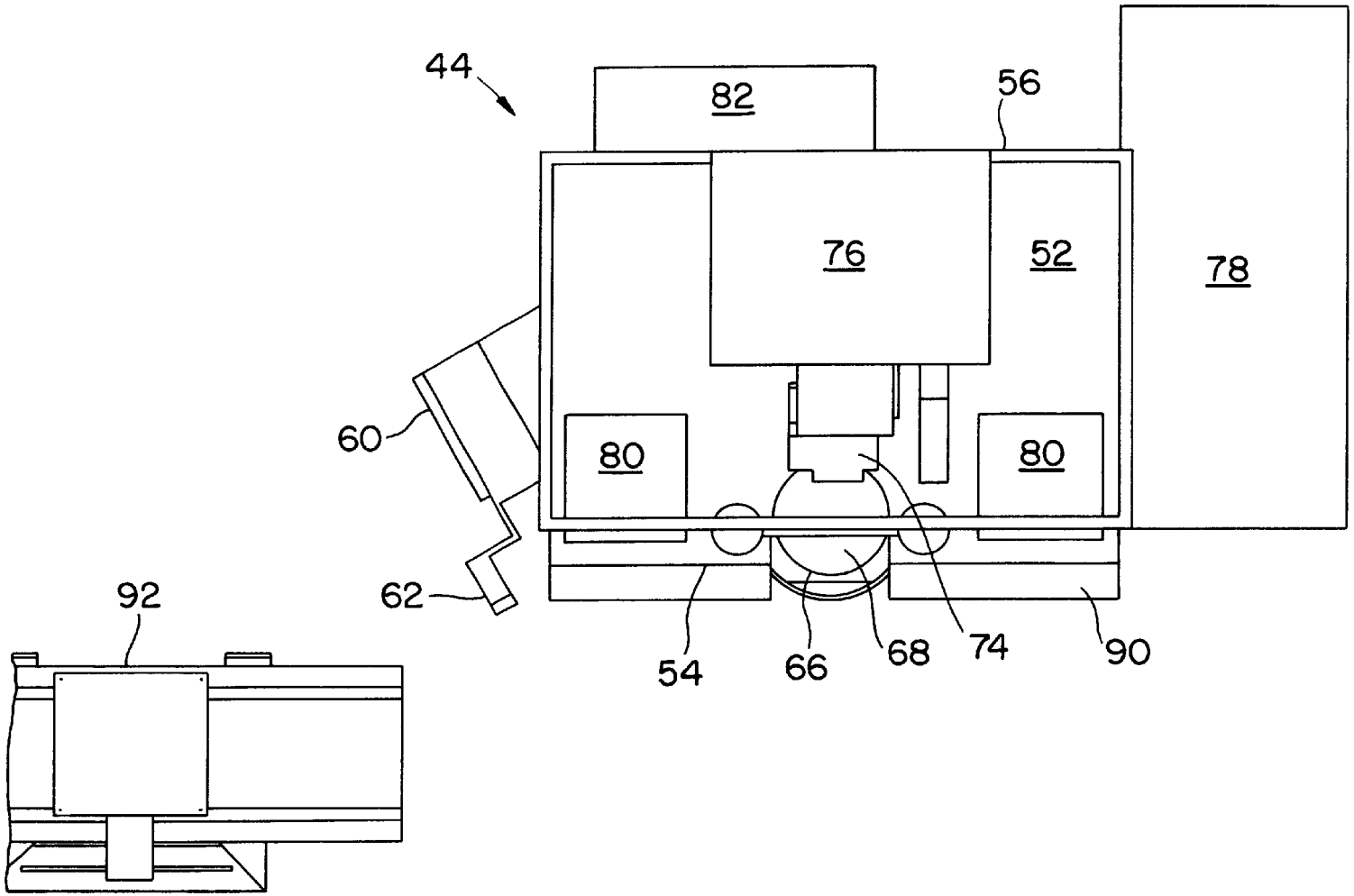
FIG. 1 is an overhead plan view of the inventive workstation.
Figure 2:
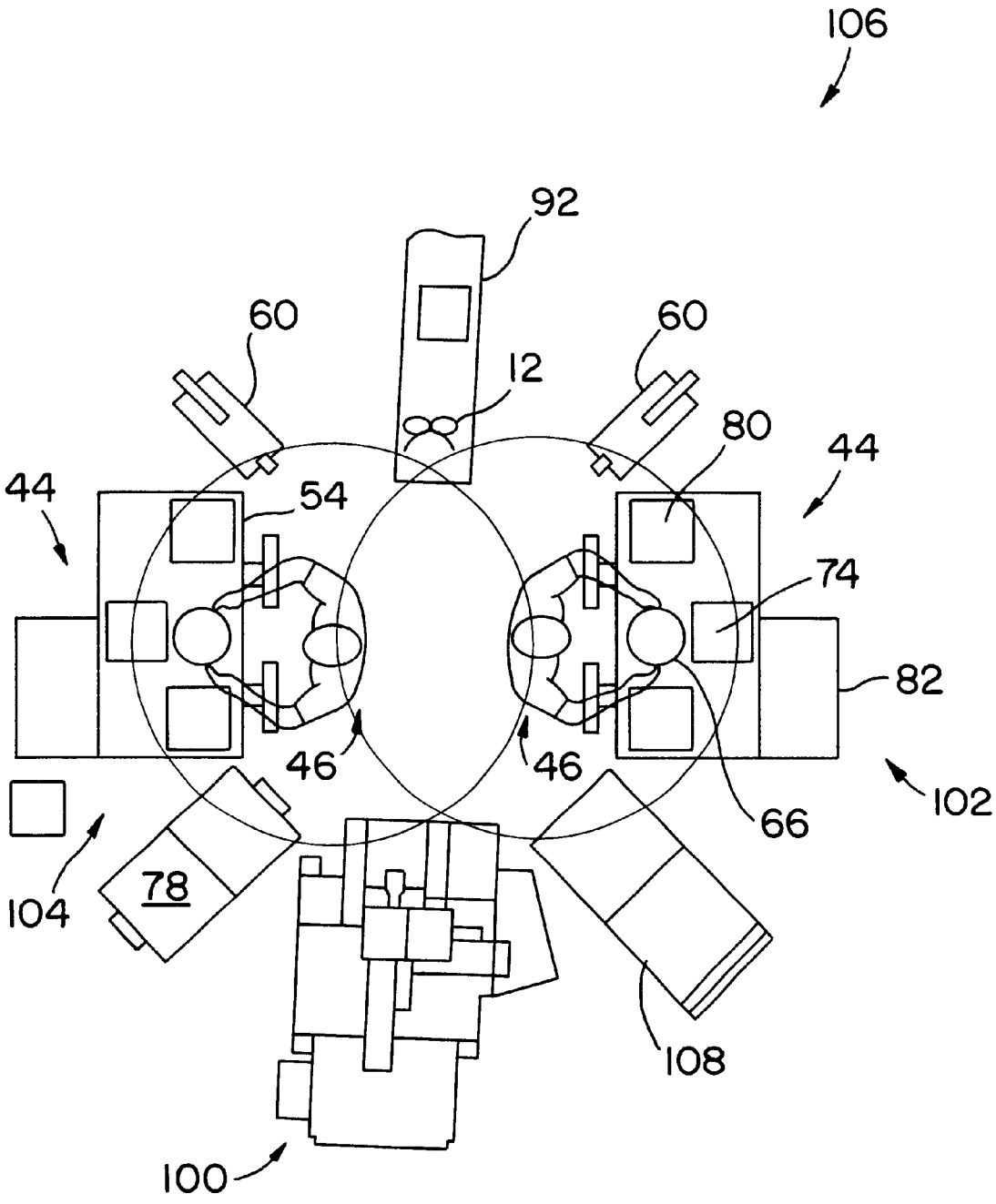
FIG. 2 is an overhead plan view of a pair of inventive workstations arranged in a kaizen cell.
Figure 3:
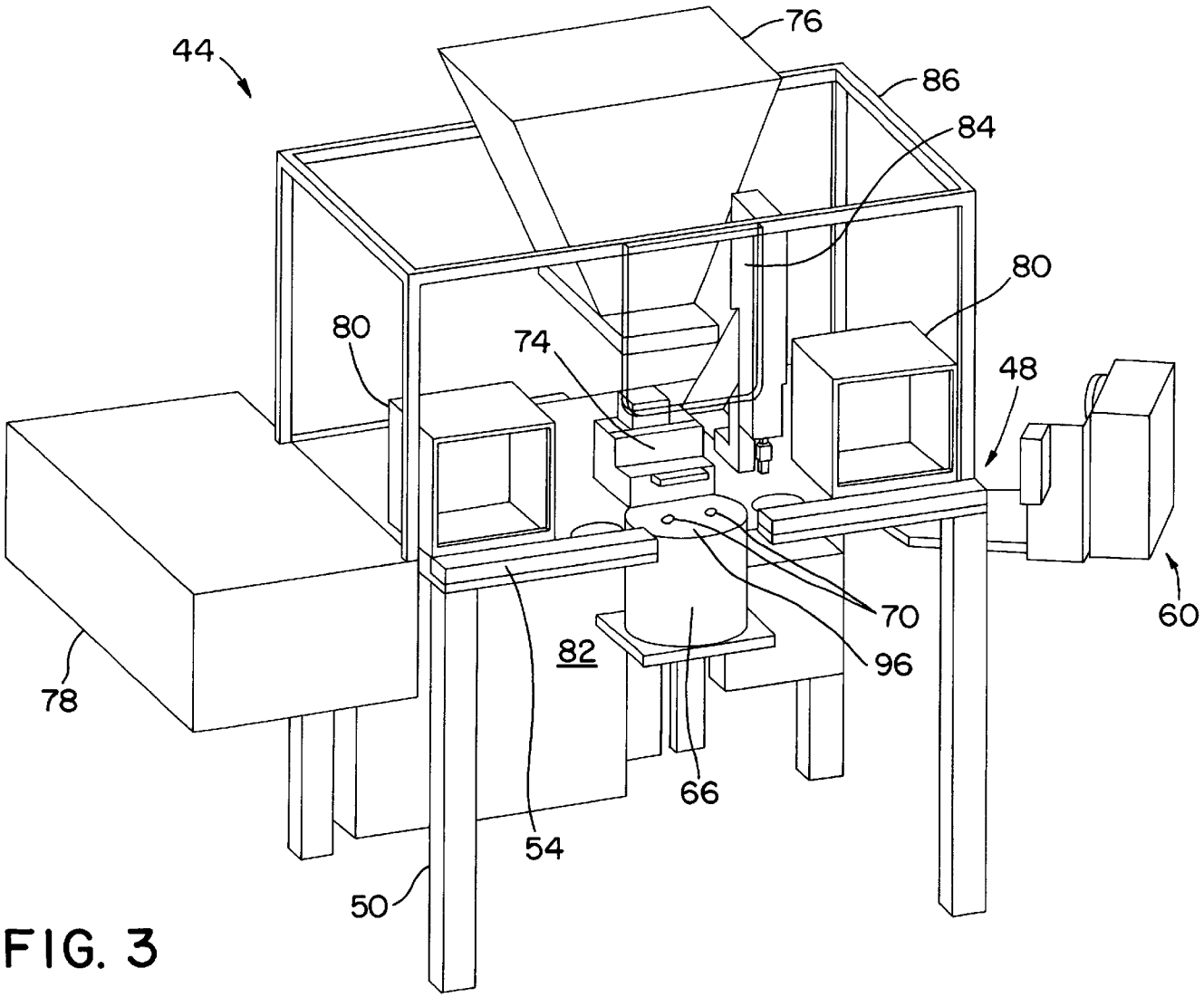
FIG. 3 is a perspective view schematically showing an inventive workstation.
Figure 4:
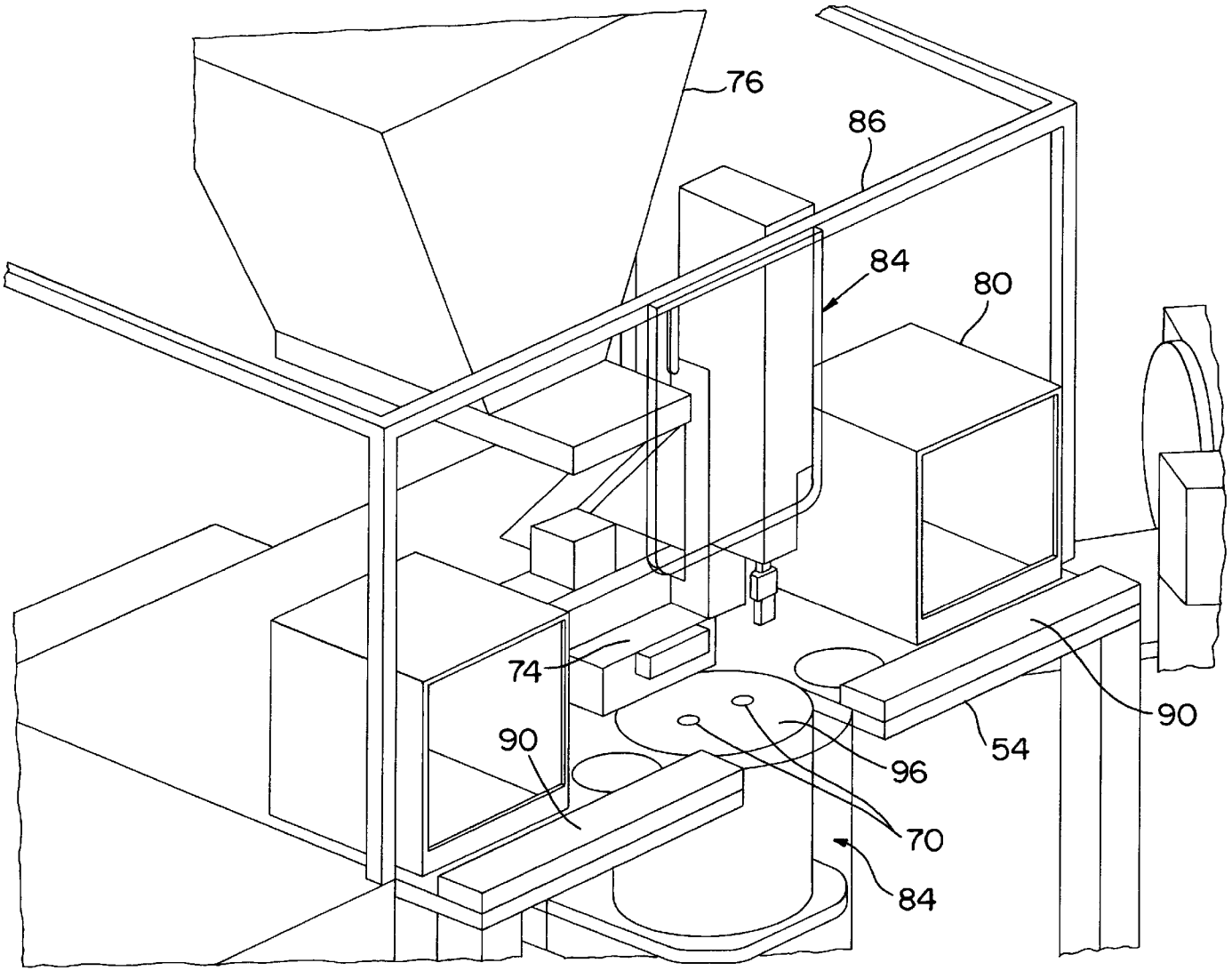
FIG. 4 is an enlarged view showing a portion of FIG. 3.
Figure 5:
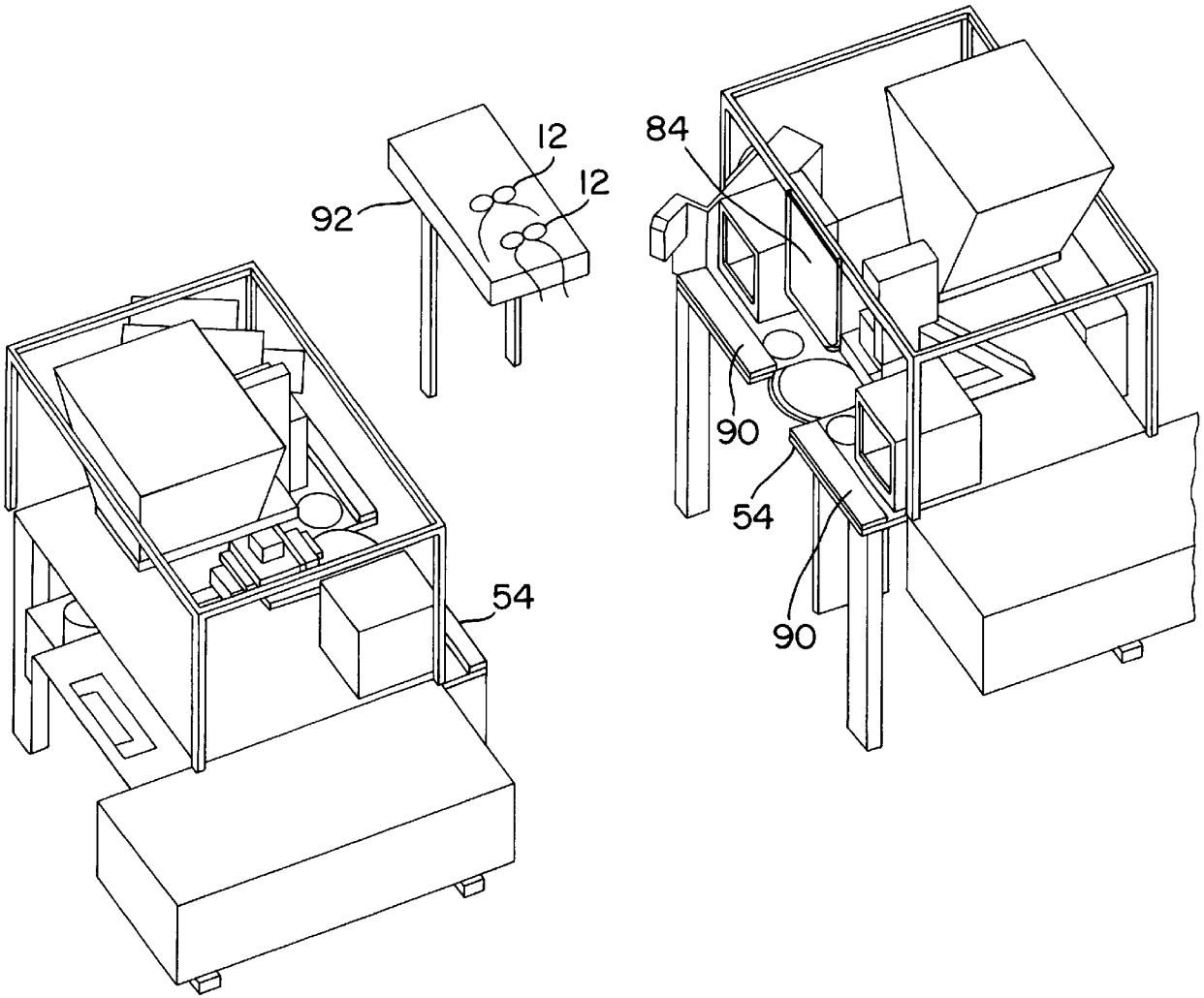
FIG. 5 is a perspective view schematically showing a pair of inventive workstations arranged in a kaizen cell.

With reference to FIGS. 1 and 3, the inventive apparatus for assembly of the above described blast initiation device comprises a workstation 44 designed for efficient utilization by a single operator 46 (shown in FIG. 2). The workstation 44 includes a support frame 48, which may comprise four vertically extending legs 50 and a generally rectangular table 52 mounted to the legs. One edge of the table defines an access position 54 for an operator with the opposing edge defining a table back edge 56.

A tagger device 60 is mounted for support to the frame 48. The tagger device 60 stores a quantity of identification tags 18 similar to those shown in FIG. 6. When a length of signal transmission line 12 is held adjacent the tagger head 62 and the tagger device is actuated, one tag 18 is wrapped around the signal transmission line 12 and affixed thereto.

A crimp device 66 is mounted to the frame 48 adjacent the middle of the access position 54. The crimp device 66 includes a crimp head 68 containing a crimp head aperture 70. A blocking device 74 is mounted to the frame 48 between the crimp device 66 and the table back edge 56.

Preferably, the workstation includes a hopper-type feeder 76 located above the blocking device 74. The hopper feeder 76 holds a plurality of connector blocks 16 for easy access by the operator 46. The workstation 44 also preferably includes safe storage devices for detonators, both bulk storage devices 78 and in lesser working quantity storage devices 80. Naturally, the workstation 44 would include electrical, hydraulic and pneumatic supply systems (only hydraulic supply system 82 shown for clarity) as well as safety devices such as guards (a portion shown as 84 in FIG. 3) attached to a guard frame 86 required by regulatory agencies such as OSHA. The workstation may also include ergonomic devices such as arm rests 90.

As shown in FIG. 2, the workstation 44 is ergonomically arranged so that all devices 60, 66, 74, 78, 80 and components 12, 14, 16, 18 are readily accessible for operation by a single operator 46. The arrangement of the devices and components allows a single operator to quickly, efficiently, and safely assemble a blast initiator device 10. Typically, the devices and components would be arranged at an ergonomic distance from the operator, defined by the operator's reach which will generally be about two feet. This will tend to place the devices and components in an arc around the operator position.

With reference again to FIGS. 1–3, an operator 46 at the access position 54 loads a first detonator 14 within the crimp head aperture 70 and a first nonmetallic bushing 88 (shown best in FIG. 8) in the axially extending channel 34 of the detonator 14. The nonmetallic bushing 88 is a tubular member with an external diameter smaller than the internal channel diameter of the detonator housing 22. Bushings 88 may be stored in any position at the workstation 44 convenient to the operator 46, such as adjacent the small quantity detonator storage 80. The operator 46 reaches for a coiled length of signal transmission line 12, preferably provided at a conveyor 92. The conveyor is arranged with relation to the workstation 44 so that minimal operator 46 movement from the access position 54 is required. The operator 46 grasps the coiled length of transmission line 12 and holds a length of transmission line adjacent the first end to the tagger head 62. Actuation of the tagger device 60 causes an identification tag 18 to be affixed to the transmission line 12. The operator 46 inserts the first end of the transmission line 12 into the tubular bore of the bushing 88 within the crimp device aperture 70 so that the end of the transmission line 12 is adjacent the detonator explosive charge 28. While maintaining the transmission line end adjacent the detonator explosive charge, the operator 46 actuates the crimp device 66. The crimp device 66 functions to apply force to the exterior of the detonator housing 22 adjacent the open end 26. The applied force plastically deforms the metallic detonator housing 22 to create a crimp or cannelure 40, thereby fixing the detonator housing 22 to both the bushing 88 and transmission line 12. The crimp device 66 is adjustable as is well known to vary crimp 40 position and depth. The transmission line first end with the now fastened detonator 14 may be removed from the crimp device 66 and a second detonator 14 and bushing 88 inserted into the crimp head aperture 70. The free second end of the transmission line 12 may be inserted into the bushing 88 and the process repeated to crimp the second detonator 14 to the second end of the transmission line 12.

Preferably, the crimp device 66 comprises a dual crimp head 96 as shown in FIG. 3. In this configuration, the crimp head 96 includes two apertures 70, each receiving a detonator 14 and a bushing 88 therein. It should be appreciated that the dual crimp head 96 may accommodate different detonators having different sizes, different forces or different delays in each aperture. The operator 46 inserts each end of a tagged transmission line into the appropriate detonator/bushing subunit within a crimp head aperture 70 and actuates the crimp device 66. In this embodiment, a detonator housing 22 is crimped to a bushing 88 and each end of the transmission line 12 substantially simultaneously.

In either embodiment, after crimping the operator 46 removes one end of the transmission line 12 including the now affixed detonator 14, and inserts the affixed detonator 14 into a connector block 16 obtained from the connector block feeder 76. Typically, the detonator 14 affixed to the first or tagged end of the transmission line 12 is mounted within the connector block 16. The interior bore of the connector block 16 preferably includes stop members 98 as shown in FIG. 8 which seat the detonator 14 within the connector block 16. The operator 46 loads the connector block 16 containing a seated detonator 14 with signal transmission line 12 extending therefrom into the blocking device 74. While maintaining the detonator 14 against the stop members 98, the operator 46 actuates the blocking device 74. The blocking device 74 drives a locking member 38 into the channel 34 of the connector block wherein it engages the detonator 14 and locks the detonator in place with respect to the connector block 1,6 as previously described. After the blocking operation, the operator 46 removes the first end of the transmission line 12 containing the connector block 16 locked to the detonator 14. The operator 46 takes the now assembled blast initiation device 10, comprising a transmission line 12 including a tag 18 with a detonator 14 affixed to each end by crimping and a connector block 16 mounted at one end by engagement of the locking member 38 with the detonator 14, and places the assembled device 10 in a bundler 100.

As shown in FIG. 2, the bundler 100 is preferably located separately from the workstation 44, although, within easy reach of the operator access position 54. The bundler 100 functions to wrap a tape or band 20 around the coiled blast initiation device 10 to create a bundled device as shown in FIG. 6. The completed blast initiation device 10 may include many meters of coiled transmission line and the tape 20 functions to prevent the transmission line 12 from becoming tangled during handling. While not shown in FIG. 6, the operator 46 preferably places the ends of the blast initiation device 10 within the center of the coiled transmission line 12 so that the tape 20 serves to hold the ends as well as the transmission line 12. Naturally, a plurality of blast initiation devices could be wrapped with a single tape 20 at the bundler 100, if desired. Once bundled, the completed blast initiation device 10 is ready for packing into appropriate containers or storage or shipping.

As shown in FIG. 2, a first and second workstation, 102 and 104 respectively, may be incorporated into a kaizen cell 106 which shares under utilized facilities such as the transmission line conveyor 92, bundler 100, bulk detonator storage 78 and a packing station 108. Since the cycle times of the conveyor 92 and bundler 100 are shorter than the cycle time for assembly of a blast initiation device 10 by an operator 46 at the inventive workstation, 102, 104, the sharing of,such facilities decreases total cell cost while maintaining optimum output from each workstation. Additionally, only one operator 46 is required to intermittently bundle and package the bundled blast initiation devices into containers, allowing the other operator to continue assembly of blast initiation devices. This further increases efficiency of the cell when compared to two separate workstations. As each workstation may be designed generally in an arc or circle around the operator, the kaizen cell will be arranged around some point at which the workstation arcs or circles meet.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A method for assembling an explosive device comprising:

providing a workstation having an access position and comprising a power-driven crimp device and a power-driven blocker device, each said device mounted to a frame;

providing a length of signal transmission line having first and a second ends to the workstation;

mounting a tag to said line; and mounting a first detonator to said first end of said line with the crimp device;

wherein all of said mounting steps are each performed from the access position.

2. The method of claim 1 comprising the step of mounting a second detonator to said second end of said line with the crimp device.

3. The method of claim 2 wherein the step of mounting said first detonator to said first end of said line and the step of mounting said second detonator to said second end of said line are performed substantially simultaneously.

4. The method of claim 1 comprising the step of mounting a connector block to said first detonator with the blocker device after said first detonator is mounted to said line.

5. The method of claim 1 wherein said step of mounting said first detonator to said first end of said line comprises placing said line first end within a tubular channel in said detonator and crimping said detonator to said line to form a crimp in said detonator.

6. The method of claim 5 comprising the step of inserting said crimped first detonator within an aperture in a connector block and driving a locking member having legs into the connector block, said locking member fitting within said first detonator crimp to axially immobilize said first detonator with respect to said connector block.

7. The method of claim 1 further comprising the steps of assembling a predetermined number of explosive devices and bundling said predetermined number of explosive devices.

8. The method of claim 1 comprising the step of sealing one said line end.

9. A workstation for assembling an explosive device comprising:

tagger means for mounting a tag to a length of signal transmission line having first and second ends;

crimp means adjacent said tagger means for mounting a first detonator to said first end of said line;

blocker means adjacent said cap crimp means for locking a connecting block to said first detonator;

wherein said tagger, crimp and blocker means are arranged on the workstation for ease of operation by a single operator.

10. The workstation of claim 9 comprising an access position consisting essentially of a single access point for a single person to operate said workstation.

11. The workstation of claim 9 wherein said crimp means comprises dual crimp head means for mounting said first detonator to said first line end and a second detonator to said second line end substantially simultaneously.

12. The workstation of claim 9 further comprising a frame to which said tagger, crimp and blocker means are mounted.

13. The workstation of claim 9 further comprising block feeder means for feeding said block connector to said operator.

14. The workstation of claim 9 further comprising adjacent line feeder means for feeding said length of line to said operator.

15. The workstation of claim 9 wherein said first detonator includes a channel, said line first end is inserted within said channel and said crimp means comprises a crimping device for crimping sail first detonator.

16. The workstation of claim 15 wherein said blocker means comprises a device for driving a locking member having legs into said connector block, said locking member legs fitting within a cannelure formed by said first detonator crimp to axially immobilize said first detonator with respect to said connector block.

17. A kaizen cell for assembling blast initiation devices comprising:

first and second workstations each comprising a tagger device for mounting a tag to a length of signal transmission line having first and second ends, a detonator crimp device for mounting a first detonator to said first end of said line, a blocker device for locking a connecting block to said first detonator, and an access position for a single operator, wherein said tagger, detonator crimp and blocker devices are spatially arranged adjacent said access position for ease of operation by said single operator; and a feeder providing said length of signal transmission line to a position readily accessible from both said first and second access positions.

18. The kaizen cell of claim 17 further comprising bundler means for bundling a predetermined number of assembled blast initiation devices, said bundler means having an input end readily accessible from both said first and second operator access positions and an output end.

19. The kaizen cell of claim 17 comprising an operator packing station not readily accessible from said first and second operator access positions, an operator from one of said first or second workstations being movable to said operator packing station to transfer a plurality of assembled blast initiator devices into a container while an operator from the other of said first or second workstations at said respective operator access station assembles said blast initiation devices.

20. The kaizen cell of claim 17 wherein said first and second workstations are positioned in front to front relationship.

* * * * *

UNITED STATES PATENT AND TRADEMARK OFFICE

CERTIFICATE OF CORRECTION

PATENT NO. : 6,386,085 B1
DATED : May 14, 2002
INVENTOR(S) : Garrett

It is certified that error appears in the above-identified patent and that said Letters Patent is hereby corrected as shown below:

Column 8,
Line 7, after “crimping” change “sail” to -- said --.

Signed and Sealed this

Third Day of December, 2002

JAMES E. ROGAN
*Director of the United States Patent and Trademark Office*